United States Patent [19]

Goller et al.

[11] Patent Number: 4,790,151

[45] Date of Patent: Dec. 13, 1988

[54] YARN STOP MOTION FOR TEXTILE MACHINES

[75] Inventors: Ernst Goller, Reutlingen; Fritz Walker, Kusterdingen; Franz Schmid, Bodelshausen, all of Fed. Rep. of Germany

[73] Assignee: H. Stoll GmbH & Co., Reutlingen, Fed. Rep. of Germany

[21] Appl. No.: 102,621

[22] Filed: Sep. 30, 1987

[30] Foreign Application Priority Data

Sep. 30, 1986 [DE] Fed. Rep. of Germany ..... 3633108

[51] Int. Cl.[4] ..... D04B 3/06

[52] U.S. Cl. ..... 66/125 R; 66/157; 242/157 C

[58] Field of Search ..... 66/157, 156, 125; 242/157 C

[56] References Cited

U.S. PATENT DOCUMENTS

| | | | |
|---|---|---|---|
| 837,389 | 12/1906 | Dronsfield | 242/157 C |
| 910,312 | 1/1909 | Prest | 242/157 C |
| 959,465 | 5/1910 | Cook | 242/157 C |
| 1,134,336 | 4/1915 | Houghton | 242/157 C |
| 1,392,743 | 10/1921 | Bull | 242/157 C |
| 3,084,500 | 4/1963 | Recher | 242/157 C |
| 3,269,104 | 8/1966 | Morita | 242/157 C |
| 4,393,647 | 7/1983 | Kitamura | 242/157 C |

*Primary Examiner*—Ronald Feldbaum
*Attorney, Agent, or Firm*—Larson and Taylor

[57] ABSTRACT

A front yarn guide element (11) of the yarn stop motion (10) has the shape of a yarn guide eye (12) formed by a wire spiral into which a yarn can be introduced from the side and deflected to all sides without danger of slipping out. The yarn guide eye (12) is provided with a supporting part (17) located so as to be longitudinally movable in the housing (18) of the yarn stop motion (10), so that the spacing of the yarn guide eye (12) from the position (B) at which the yarn stop motion (10) is secured is adjustable.

4 Claims, 3 Drawing Sheets

YARN STOP MOTION FOR TEXTILE MACHINES

DESCRIPTION

Figure 1:
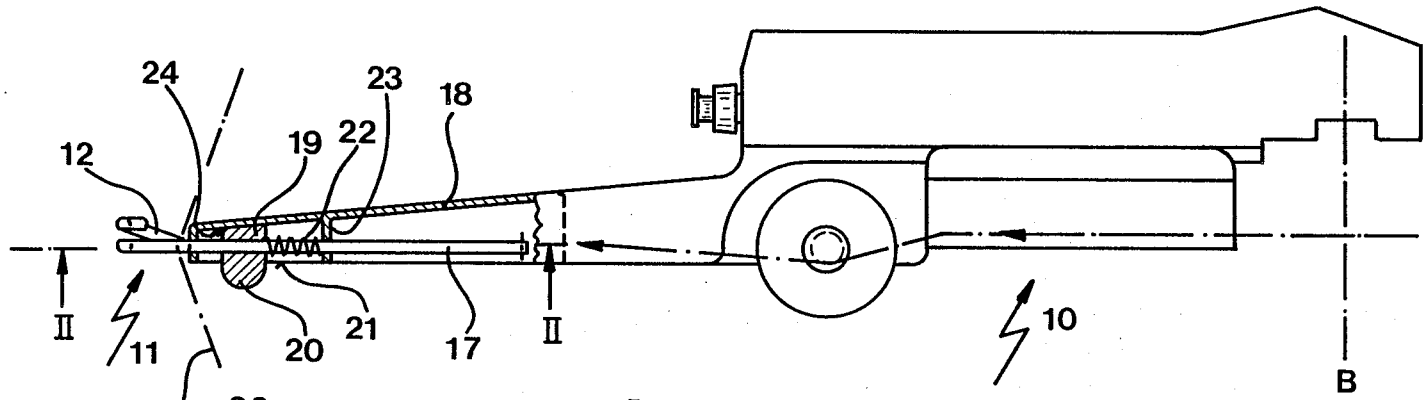

The invention relates to a yarn stop motion for textile machines, with a housing which can be secured on a carrier rail and which has a yarn guide member at its front end into which the yarn or thread can be introduced from the side. A yarn stop motion of this kind is known, for example, from DE-OS No.29 19 916 in the name of the applicant.

In flat knitting machines or warp knitting machines a number of yarn stop motions are arranged adjacent one another on a carrier rail. If these yarn stop motions deliver yarns to the same yarn operating position or to yarn feeders adjacent one another, there is the danger that the yarns coming from the several yarn stop motions will touch one another which must be avoided under any circumstances. The danger is especially great if the yarn guide member located at the end of the yarn stop motion effects a deflection of the yarn in a direction extending at an acute angle to the yarn guide rail. This situation occurs especially in flat knitting machines in which all the yarns must first be led in a direction to one end of the machine.

The problem which is the basis of the invention is so to construct a yarn stop motion of the kind set out in the introduction that, without alteration of the position in which the yarn stop motion is mounted, measures can be taken to avoid a threatened contact of the yarn coming from it with the yarn or yarns from one or more neighbouring yarn stop motions.

This problem is solved according to the invention in that in the yarn stop motion set forth the yarn guide member is formed on a support which is movable and securable on or in the yarn stop motion housing with the object of enabling the spacing of the yarn guide member from the position at which the yarn stop motion housing is secured to be adjusted.

A yarn stop motion according to the invention allows the spacing of its yarn guide member from the position at which its housing is secured on the yarn guide rail to be adjusted and thus in the case of several, adjacent yarn stop motions various spacings can be set for their yarn guide members, so that there is introduced an enhanced spread of the yarns coming from the yarn stop motion and thus a greater spacing between the individual yarns coming off.

Advantageously, the yarn guide member can be constructed from a bent round rod or wire as a yarn guide eye in the form of a spiral with at least 5/4 turns. Thereby is the additional advantage achieved that a yarn introduced into this yarn guide member can, in practice, be deflected to all sides without danger that it will, undesirably, again be pulled out of the gap in the spiral through which it was introduced, upon take-off of the yarn. Suitably, the coils of the yarn guide eye can be so formed that they form an oblong aperture, whose longitudinal axis extends in the longitudinal direction of the yarn stop motion housing or parallel thereto, whereby preferred regions for the accommodation of the yarn in the eye are created.

Suitably, the yarn guide member and the support can be made in one piece from a round rod or wire and the support can comprise a straight section of rod, which, to prevent rotation, has in at least one circumferential position a flat region extending over at least part of its length and by which it is guided in the housing. The adjustability can be achieved either in a stepwise fashion or continuously, to which end the support can be provided with detent recesses or projections or with an outer screw thread. Advantageously, to achieve a continuous adjustment, there can be located on the part of the straight support for the yarn guide member within the housing, for cooperation with an inclined surface of the housing, a wedging slide which has a gripping part projecting outwardly and which is under the influence of a tension spring and is movable against the force of this tension spring out of a clamping position into a free position.

With the yarn stop motion constructed according to the invention, an operator can, in a simple manner, carry out an adjustment of the yarn guide member even after the yarns have been introduced, should the danger of a collision with another yarn in a position in the textile machine show up. A further advantage consists in that the yarn guide member with its support can be formed so that it can be easily interchanged so that yarn guide members in which broken pieces of yarn have been caught up can be easily changed for new yarn guide members. In addition, in order to suit different yarns or threads, differently sized or shaped yarn guide members can be selectively fitted into the yarn stop motion.

An embodiment of the subject matter of the invention will be described below in greater detail with reference to the accompanying drawing.

Figure 2:
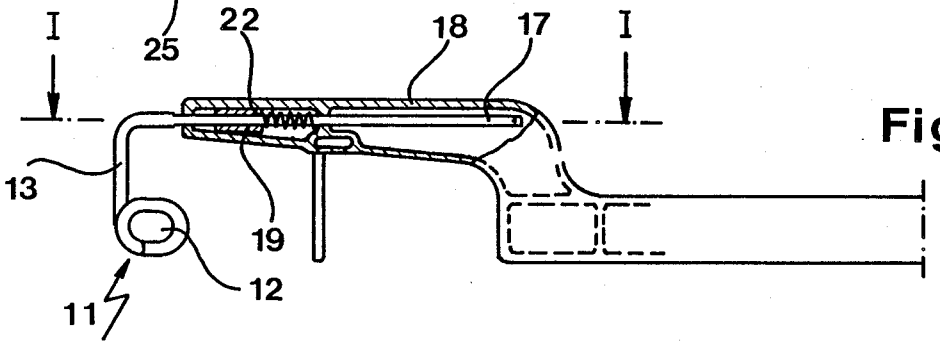
Figure 3:
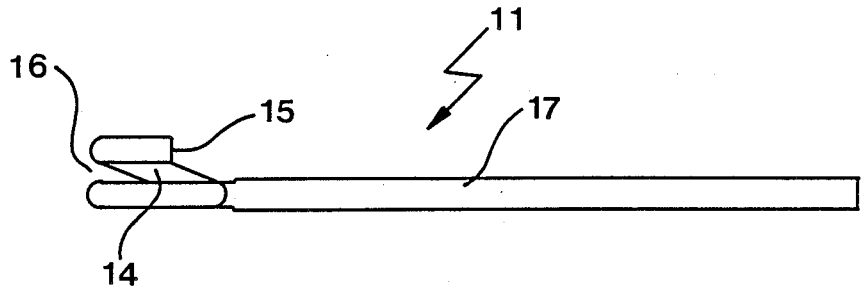
Figure 4:
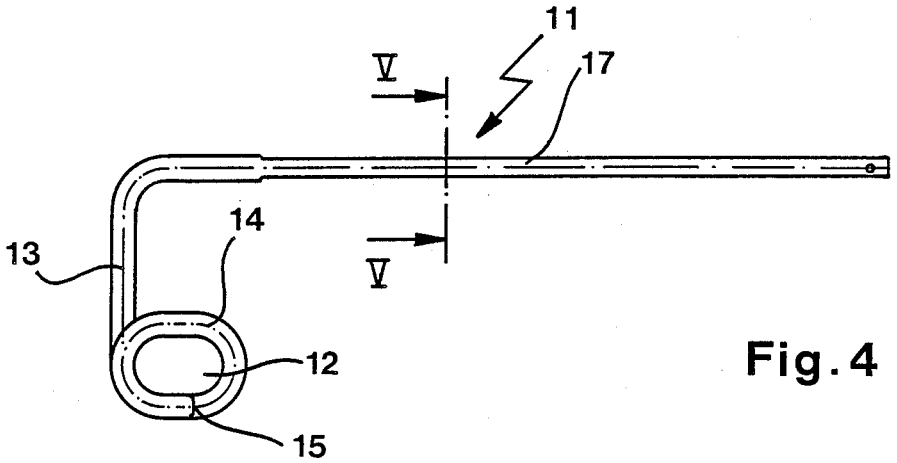
Figure 5:
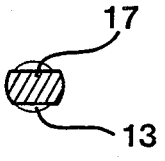
Figure 6:
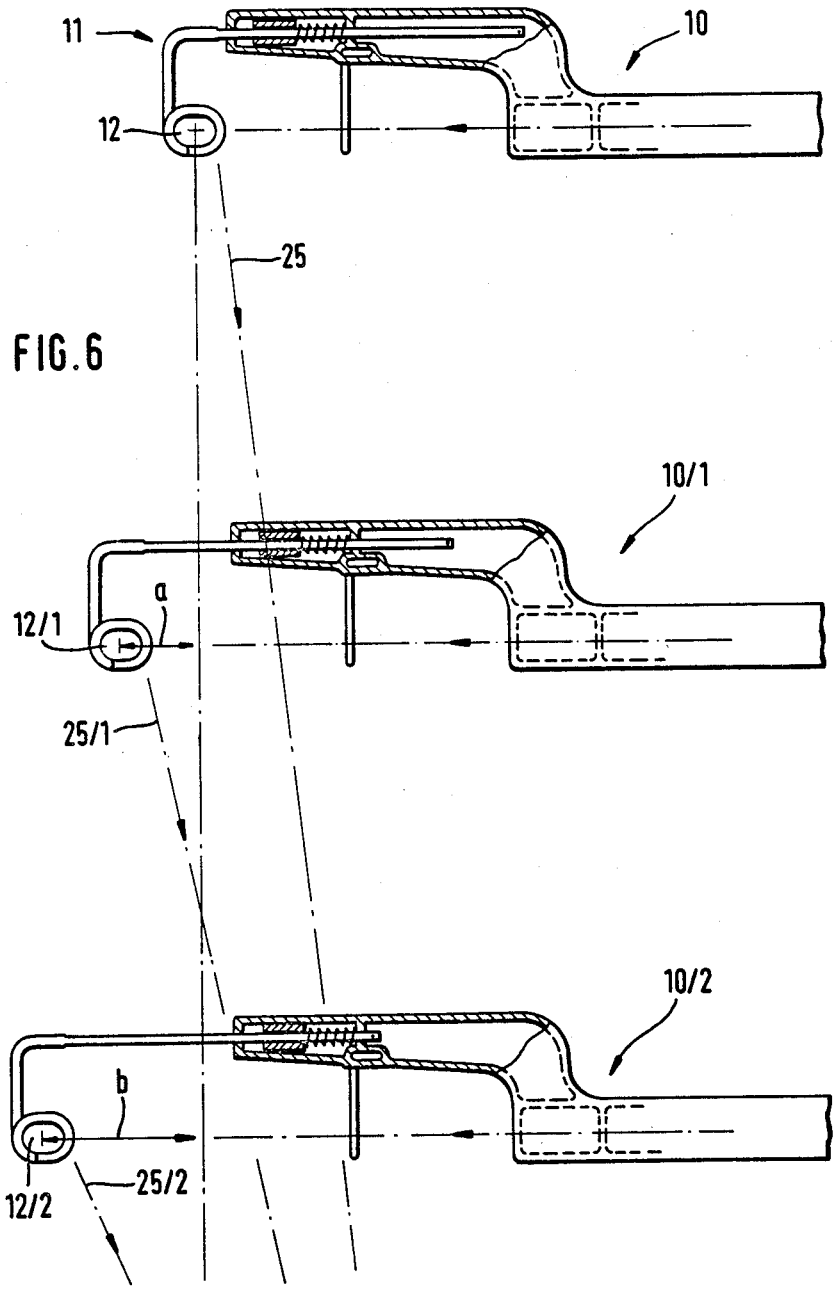

In detail there is shown in:

FIG. 1 a schematic side view of a yarn stop motion with its front end in section along the line I—I in FIG. 2;

FIG. 2 a partial plan view of the yarn stop motion with its front end in section along the line II—II in FIG. 1;

FIG. 3 a detail side view of the yarn guide member and its support on an enlarged scale compared with FIGS. 1 and 2;

FIG. 4 a plan view of the yarn guide member of FIG. 3;

FIG. 5 a cross-section through the support part of the yarn guide member along the line V—V in FIG. 4 on an enlarged scale compared with FIG. 4;

FIG. 6 a plan view of three adjacent yarn stop motions located on the same mounting with differently adjusted yarn guide members.

FIG. 1 shows a yarn stop motion 10 for a knitting machine. The construction of its stop motion parts with a yarn break switch, a yarn break indicator, a yarn brake and yarn sensors is not of interest here. Only a yarn guide member located at its front end and indicated generally by the reference numeral 11 is essential to the invention. The yarn guide member 11 shown in detail in FIGS. 3 to 5 is made in one piece from a round wire and comprises a yarn guide eye 12 oblong in form. To form it, the end of the round wire 13 is bent to the shape of a spiral 14, which has 5/4 turns. The end 15 of the wire is located according to FIGS. 3 and 4 above a longitudinal side of the oblong yarn guide eye 12. The turns of the yarn guide eye 12 do not touch, so that as shown in FIG. 3, there exists a gap 16 in the wire spiral through which a yarn can be introduced into the yarn guide eye 12 from the side, which thus need not be threaded into the yarn guide eye 12 by its end. However, since the wire spiral has more than one turn and the end 15 of the wire lies above another section of the wire spiral in the projection of FIG. 4, a yarn introduced into it can in practice no longer spring out of the gap 16 irrespective of which section of the wire spiral of the yarn guide eye 12 the yarn introduced lies against.

In the region of its other end the round wire 13 is formed into a straight wire section 17, which as shown in the cross-sectional representation of FIG. 5, is flattened on two oppositely located sides by pressing. The straight wire section 17 forms a support for the yarn guide member 11, by which it is mounted in supporting openings of the housing wall for longitudinal movement in the forward part 18 of the housing of the yarn stop motion. Locking of the yarn guide member 11 is achieved by means of a wedging slide 19 located inside the forward part 18 of the yarn stop motion housing and which has a bore through it through which the straight wire section 17 is led and which, further, has a gripping part 20, visible in FIG. 1, which projects outwardly through a slot 21 formed in the yarn stop motion housing. The wedging slide 19 is under the influence of a spiral spring 22 pushed onto the wire section 17 and which is fitted between the wedging slide 19 and an intermediate wall 23 of the forward part 18 of the yarn stop motion housing. The wedging slide cooperates with an inclined surface 24 of the part 18 of the housing. By pushing the wedging slide 19 against the force of the spiral spring 22, the wire section 17 is released so that the yarn guide member 11 can be displaced in the part 18 of the housing in order to increase or decrease the spacing of the yarn guide eye 12 from the securing position B of the yarn stop motion 10 indicated in FIG. 1. After it is released, the wedging slide 19 is urged by the spiral spring 22 against the inclined surface 24 of the part 18 of the housing and the yarn guide member 11 is thus clamped securely in the part 18 of the housing in the position to which it is adjusted.

Due to the construction of the yarn guide eye 12, a yarn 25 guided by it can lie against any position on its inner circumference without there being any danger that the yarn 25 can slip out again through the gap 16 in the spiral. Due to the oblong shape of the eye 12, positioning of the yarn 25 in the end regions of the oblong yarn guide eye 12 is favoured. Due to the adjustable arrangement of the yarn guide member 11, when yarn stop motions 10, for example as seen in FIG. 6 three yarn stop motions 10, 10/1, 10/2, are located adjacent one another, the spacing between the yarns 25, 25/1, 25/2 guided by their front yarn guide eyes 12, 12/1, 12/2 to the same yarn operating position, can be increased, by sliding the yarn guide eye 12/1 further out of the housing of the associated yarn stop motion 10/1 by a distance a and sliding the yarn guide eye 12/2 further out of the housing of the associated yarn stop motion 10/2 by a still greater distance b when the yarn guide eye 12 of the uppermost yarn stop motion 10 is located relatively close to the yarn stop motion housing.

The longitudinal axis of the yarn guide eye 12 extends in the embodiment illustrated parallel to the longitudinal direction of the yarn stop motion housing. Instead of the clamping arrangement shown, the support for the yarn guide eye can also have detent recesses or projections for detent location. Further, the rod-shaped support can be provided outwardly with a screw thread and can be mounted in a screw-threaded sleeve of the housing and secured by means of a clamping screw.

We claim:

1. A yarn guide assembly for use with a stop motion mechanism of a textile machine comprising:

a housing which can be carried on a carrier rail, said housing including a front end;

a yarn guide member at the front end of said housing into which the yarn or thread is introduced from the side, said yarn guide member being made from a one-piece round wire or rod and including (a) a yarn guide eye formed by a spiral of at least 5/4 turns of said wire or rod and (b) a support formed from a straight section of said wire or rod and having in at least one circumferential position a flat region extending over at least a part of the length thereof;

an adjustable securing means for securing said support of said yarn guide member to said housing so that said support is adjustably movable in said securing means and thus the distance of said yarn guide eye from said housing is adjustable; and a guide means in which said flat region of said support is received for preventing rotation of said yarn guide member.

2. A yarn guide assembly as claimed in claim 1 wherein said adjustable securing means includes (a) a wedging slide including an engaging portion adjacent said support and a gripping part which projects outwardly from said housing such that said wedging slide is manually movable thereby, (b) an inclined surface on said housing adjacent said wedging slide, and (c) a spring means for resiliently forcing said wedging slide against said inclined surface whereby said engaging portion of said wedging slide is forced into clamping engagement with said support to secure said support against movement and whereby said gripping part is manually movable against the force of said spring means to move said engaging portion of said wedging slide away from said inclined surface and out of clamping engagement and thus to allow movement of said support relative to said wedging slide.

3. A yarn guide assembly as claimed in claim 2 wherein said wedging slide includes an aperture therein through which said flat region of said support extends, said aperture having a cross section similar to the cross section of said support at said flat region whereby said aperture forms both said engaging portion and said guide means.

4. A yarn guide assembly according to claim 1, characterized in that said yarn guide eye forms an oblong aperture, whose longitudinal axis extends parallel to a longitudinal direction of said housing.

* * * * *